United States Patent [19]

Gurries

[11] 4,252,376

[45] Feb. 24, 1981

[54] RIPPING TOOL DRIVING APPARATUS

[75] Inventor: Raymond A. Gurries, Reno, Nev.

[73] Assignee: The Gurries Company, Sparks, Nev.

[21] Appl. No.: 25,483

[22] Filed: Mar. 30, 1979

Related U.S. Application Data

[63] Continuation-in-part of Ser. No. 905,347, May 12, 1978, abandoned, and Ser. No. 973,187, Dec. 26, 1978.

[51] Int. Cl.[3] ..... A01B 35/00

[52] U.S. Cl. ..... 299/37; 37/DIG. 18; 172/40; 173/49; 299/14

[58] Field of Search ..... 299/14, 37; 173/49; 175/55; 172/40; 37/DIG. 18

[56] References Cited

U.S. PATENT DOCUMENTS

| | | | |
|---|---|---|---|
| 3,367,716 | 2/1968 | Bodine | 173/49 X |
| 3,633,683 | 1/1972 | Shatto | 299/14 X |
| 3,770,322 | 11/1973 | Cobb et al. | 299/37 |
| 3,857,609 | 12/1974 | Felix | 299/14 |
| 3,897,975 | 8/1975 | Cobb et al. | 299/14 |
| 4,003,603 | 1/1977 | Stemler et al. | 299/37 |

FOREIGN PATENT DOCUMENTS

| | | | |
|---|---|---|---|
| 183133 | 6/1966 | U.S.S.R. | 299/37 |

*Primary Examiner*—Ernest R. Purser
*Attorney, Agent, or Firm*—Townsend and Townsend

[57] ABSTRACT

A ripping tool positioned below the earth's surface is driven by the output of a vibrating, preferably, resonant, force transmitting beam which has lateral dimensions smaller than those of the ripping tool and is positioned below the earth's surface. The beam is configured to have a single resonant node when restrained from vibrating at such node and is supported so that the single node is above the earth's surface and restrained from vibrating. The output of the beam is enlarged in thickness to form a hammer.

5 Claims, 8 Drawing Figures

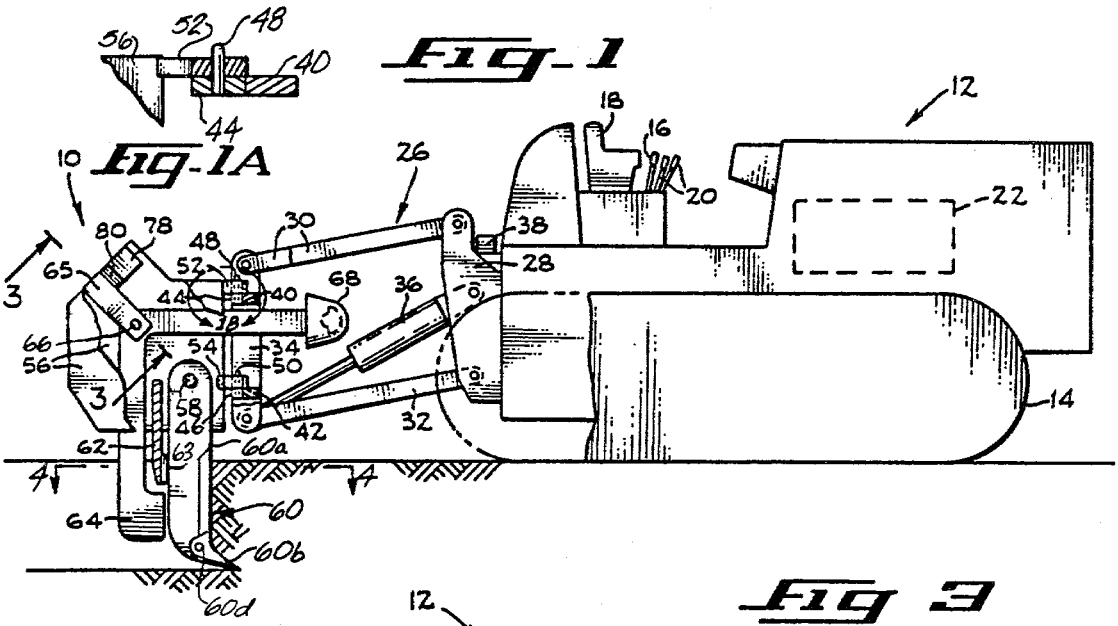
Fig. 1
Fig. 1A
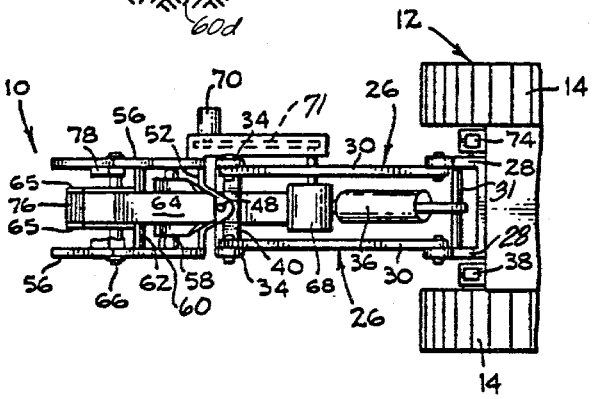
Fig. 2
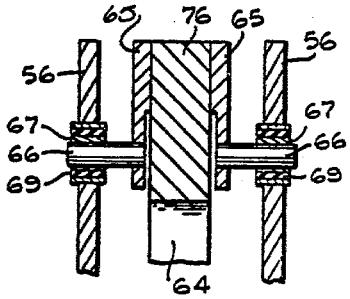
Fig 3
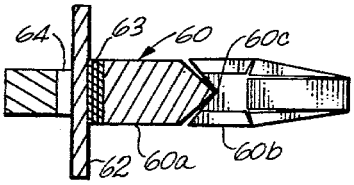
Fig. 4
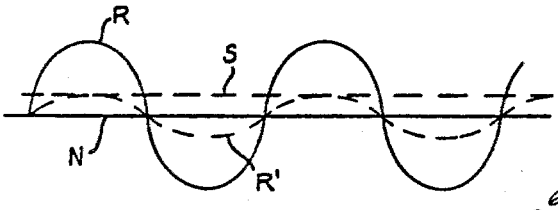
Fig. 5
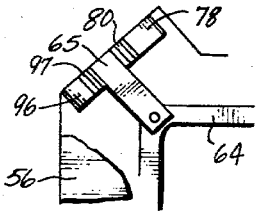
Fig. 7
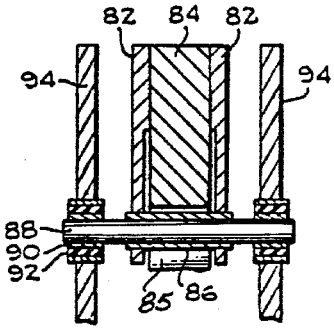
Fig. 6

RIPPING TOOL DRIVING APPARATUS

CROSS REFERENCE TO RELATED APPLICATIONS

This application is a continuation-in-part of my copending application Ser. No. 905,347 filed May 12, 1978 and now abandoned and my application Ser. No. 973,187 filed Dec. 26, 1978, the disclosures of which are incorporated fully herein by reference.

BACKGROUND OF THE INVENTION

The present invention relates generally to power driving mechanisms, and more particularly to apparatus utilizing a vibratory member for driving a ripping tool into earth, rock, or other earthen material.

Apparatus is known in which a ripping tool is driven by a vibratory member. For example, Bodine U.S. Pat. No. 3,336,082 discloses a rock ripping tooth that is integral with the lower end of a straight resonant beam. Cobb et al U.S. Pat. Nos. 3,770,322 and 4,003,603 describe a ripping tool that is mounted for reciprocal motion; a source of oscillatory force is coupled by a non-resonant force transmitting rod to a hammer that periodically strikes the tool. Shatto U.S. Pat. No. 3,633,683 discloses a pivotally mounted ripping tool that is driven by a hammer located above the earth's surface. The hammer is attached to the lower end of a straight resonant beam to which a source of vibrations is coupled. The requirement that the support for the force transmitting beams be above ground and the ripping tool be below ground makes difficult the design of apparatus for efficiently driving the ripping tool, because of the restraints on the component location and space occupancy.

SUMMARY OF THE INVENTION

According to the invention, a reciprocally mounted ripping tool is driven by a vibrating, preferably, resonant, force transmitting member, the output of which has smaller lateral dimensions than the ripping tool. The force transmitting member is supported so its output lies below the earth's surface in close proximity to the cutting surface of the ripping tool. The lateral thickness of the ripping tool serves to divert the earthen material outwardly away from the path of the output of the force transmitting member. Preferably, the shank of the ripping tool lying above its cutting surface has its centrally located vertical leading edge that helps cut through the earthen material and divert it outwardly away from the force transmitting member.

A feature of the invention is a resonant force transmitting member having a single node. The force transmitting member is supported so that the single node is above the earth's surface while its output is located below the earth's surface in proximity to the cutting surface of the ripping tool. The use of a resonant force transmitting member having a single node shrinks the longitudinal space requirements for the resonant member for a given tool driving stroke.

BRIEF DESCRIPTION OF THE DRAWINGS

The features of a specific embodiment of the best mode contemplated of carrying out the invention are illustrated in the drawings, in which:

FIG. 1 is a side elevational, partially cut away view of tool driving apparatus embodying the invention, with portions broken away;

FIG. 1A is an enlargement of a portion of FIG. 1;

FIG. 2 is a top plan view of the left, operative portion of the apparatus illustrated in FIG. 1;

FIG. 3 is a fragmentary sectional view taken along line 3—3 of FIG. 1;

FIG. 4 is a fragmentary sectional view taken along line 4—4 of FIG. 1;

FIG. 5 is a graphical illustration of the operating characteristics of the described tool driving apparatus;

FIG. 6 is a fragmentary sectional view of a slightly modified version of the apparatus in FIG. 3; and FIG. 7 is a side view of an alternative version of a portion of the apparatus of FIG. 1.

DETAILED DESCRIPTION OF THE SPECIFIC EMBODIMENT

Tool driving apparatus employing a vibrating member in a fashion that such vibration of the beam or other force transmitting member will be maintained, regardless of various other forces applied during operation of the apparatus. To achieve such objective, a ripping tool is supported for pivotal motion from a tool frame adjustably supported at the rear of a mobile carrier in the form of a more or less standard tractor, the pivotal support being essentially transverse to the direction of motion of the tractor so that the tool, in turn, swings forwardly and rearwardly along the general direction of tractor motion. The tool frame, through its adjustable support, can be raised or lowered, and when lowered, the ripping tool can lie several feet below the surface of the earth or other material being engaged thereby.

To impart earth-cutting reciprocal motion to the ripping tool, a resonant member is utilized, and, more particularly, takes the form of an angle beam having a pair of legs supported in angular relationship from a pivotal support carried by the side plates of the tool frame so that one leg projects substantially vertically downward to lie adjacent the rear surface of the ripping tool whereas the other leg extends from the first leg at a divergent included angle of approximately ninety degrees and thus substantially horizontally forward between the frame plates, to mount at its extremity a sonic generator, eccentric weight oscillator or other means for energizing resonant vibration of the angle beam. The pivotal support therefor is at a central node position so that substantially no vibration is transmitted back to the supporting frame. The angle beam has lateral dimensions no greater than that of the ripping tool so that it can lie beneath the surface of the earth or other material being cut by the ripping tool without interfering with the operation.

A short ear extends from the angle beam upwardly from its node position and lies adjacent a stop member disposed between the plates, thus to restrict the pivotal motion of the angle beam about its pivot rod in one direction. Shims, or other means, can be used to provide for adjustment of the position of shim engagement of the ear, and thus define the neutral position of the resonant angle beam, and more particularly the lower tool engaging portion thereof. In turn, the tool is restricted by a stop with adjustment shims so that it cannot swing backward into contact with the adjacent portion of the angle beam when in its defined neutral position. Thus, regardless of forces on the ripping tool, the resonant beam is able to swing to and fro in its resonant vibration when appropriately energized by the sonic generator, eccentric weight oscillator, or other means, and no possibility of clamping the beam exists.

With reference to FIGS. 1 and 2, the ripping tool assembly 10 is mounted at the rear of a more or less conventional tractor 12 supported on mobile support means in the form of spaced endless tracks 14 for motion in a forward direction determined by a conventional steering mechanism 16 accessible to an operator seated on a driver's seat 18, with suitable adjacent controls 20 to effect not only the steering but the application of power to the endless tracks from a conventional engine 22, and also energization of hydraulic pumps 38 and 74 connected to certain hydraulic elements of the ripping tool assembly 10, as will be described hereinafter.

A heavy plate is mounted at the rear of the tractor 12 to carry at laterally spaced and substantially parallel positions a pair of parallelogram units 26, each including a rigid upstanding leg 28 at the rear of the tractor, the tops and bottoms of which carry pivotally supported legs 30, 32. Legs 30, 32 extend rearwardly, to in turn pivotally support the upper and lower ends of a vertical rear leg 34 of each parallelogram unit 26 at their rear extremities. A double-acting hydraulic ram 36 is pivotally connected between the lower end of the rear legs 34 and the middle of the front legs 28 by a cross rod 31 and another cross rod, not shown, so as to effect a raising or lowering of the rear legs of the parallelogram unit upon application of hydraulic fluid from previously mentioned pump 38 when actuated by the machine operator.

Rigid cross members 40, 42 extend transversely between the rear extremities of the parallelogram units 26 at both top and bottom to mount centrally brackets 44, 46 with aligned substantially vertical pivot pins 48, 50. Pins 48, 50, extend through aligned holes in brackets 52, 54 which are joined rigidly to side plates 56 of the ripping tool assembly 10. Thus, the ripping tool assembly 10 can pivot about the generally upright axis defined by the pins 48, 50 to accommodate turning of the tractor 12.

The side plates 56 extend in spaced parallelism rearwardly from the supporting parallelogram units 26 and carry therebetween several elements, including a horizontal pivot pin 58 which supports a ripping tool 60 therefrom for pivotal motion in forward and backward directions. The ripping tool 60 has a substantially conventional configuration, with a long shank **60*a* extending substantially vertically downwardly from the supporting pivot pin 58 and a forwardly and angularly projecting tooth 60*b* at its lower extremity. A retaining pin 60*d* holds tooth 60*b* in fixed position of the end of shank 60*a*. As illustrated in FIG. 4, the front surface of shank 60*a* converges to form a centrally located vertical leading wedge shaped edge 60*c* that helps to cut through the earth. It may be mentioned at this point that while but a single ripping tool 60 is herein shown, a series of parallel tools can be suspended if desired, each having a similar configuration. When the parallelogram unit is lowered into an operative position, the tool 60 can extend as much as several feet into the underlying earth or other surface, as shown in FIG. 1**, to provide the ripping action upon appropriate actuation of the tool driving apparatus and forward motion of the tractor, as will be described in detail hereinafter.

The ripping tool 60 is completely free to pivot forwardly into contact with the earth or other material to be worked upon, but, in accordance with the present invention, a stop member 62 with removable shims 63 is disposed between the side plates 56 of the frame, to limit its backward motion to a particular position to be described hereinafter, which will not interfere with normal machine operation.

The tool driving apparatus includes a resonant force transmitting member 64 in the form of an angle beam composed of solid steel or other resilient material and having a pair of straight integral legs extending in divergent paths at or near approximately ninety degrees from their point of juncture. The legs of angle beam 64 are preferably equal in length and the vertical end thereof is enlarged in thickness, as illustrated in FIG. 1, to form a hammer that increases the mass at the region of impact with ripping tool 60. Stop member 62 comprises a rigid bar fixed to side plates 56 of ripping tool assembly 10 between ripping tool 60 and the rest position of the vertical end of resonant member 64.

To mount the resonant angle beam 64, an integral ear 76 projects outwardly from the juncture of the legs of the angle beam so as to bisect the angle between the beam legs. As used herein the term "integral" means that the entire resonant member 64, i.e., the legs and ear 76, is cast or forged as a single unit in a one piece construction. Parallel plates 65 are attached as by welding to opposite sides of ear 76. Holes in the plates 65 aligned with the juncture of the beam receive stub shafts 66 welded or otherwise fixedly secured to the plates 65. The shafts 66 are pivotally supported in bushings 67, which are in turn mounted in hard rubber hubs 69 supported in the side plates 56. Thus, although a pivotal support is provided for the beam, it is somewhat flexible and in no way interferes with the resonant vibration of the resonant angle beam 64.

In operative disposition, the one leg of resonant angle beam 64 extends substantially vertically so the portion of enlarged thickness at its lower extremity, lies closely adjacent the rear face of the ripping tool 60 at its lower extremity, to provide, upon beam actuation, a repeated cyclical series of blows to the rear of the ripping tool, so as to drive tooth **60*b* repeatedly into the adjacent earth or other earthen material. The tool engaging portion of angle beam 64 lies below the earth's surface near tooth 60*b*, to provide optimum force transfer thereto. As shown in FIG. 1, the tool engaging portion of angle beam 64 thus lies below tracks 14. As shown in FIG. 4, the lower end of the resonant angle beam 64 has a transverse, i.e., lateral, dimension less than that of the adjacent ripping tool 60. Therefore, when earth has been dislodged by the tool, substantially no earth contact with the beam will occur. The earth is diverted outwardly by ripping tool 60** much as a mobile snow shovel pushes snow out of its path.

Means are provided to energize the resonant angle beam 64 to resonant vibration, and preferably takes the form of a sonic generator or eccentric weight oscillator 68, as shown in my copending application Ser. No. 973,161, filed on Dec. 26, 1978, herewith, the disclosure of which is incorporated fully herein by reference. Oscillator 68 is connected to the end of the horizontal leg of the resonant angle beam for actuation by a hydraulic motor 70 through a belt drive 71. Motor 70 is attached to one of the side plates 56, and fluidically connected to hydraulic pump 74 for actuation under control of the machine operator. Oscillator 68 is driven by motor 70 such that the eccentric weights rotate at or near the resonant frequency of angle beam 64, which typically is of the order of 100 cycles per second.

It is to be particularly noted that this form of resonant angle beam 64 has but a single central node, namely, at the beam juncture and ear 76 along a line bisecting the angle of beam 64, when the beam is supported so it is restrained from vibrating at the juncture as shown. The legs of the beam resonant about this single node, with anti-nodes at the ends of the legs. A relatively long lever arm is provided by each of the beam legs so that a considerable stroke, particularly of the lower end of the tool actuating leg, is produced without the necessity of a resonant member or beam of excessive longitudinal dimensions. For example, the cyclical reciprocating stroke with an angle beam having a leg length of no more than five feet can have an output amplitude adjacent the ripping tool of one inch or more. Further, the single node and the associated node support structure are spaced far from the ends of the beam in comparison to a straight resonant beam having two nodes, as disclosed in my above referenced copending application. This is important in a ripper, where the node support must be above ground level and the ripping tool must be underground. In addition, since the ends of the beam are at an angle to each other, the sonic generator is located in a plane displaced a substantial distance from the plane in which the tool is located, as illustrated in FIG. 1.

The weight of oscillator 68 urges resonant angle beam 64 to pivot or rotate about pin 58 in a clockwise direction, as viewed in FIG. 1. A stop member 78 is attached to side plates 56 and extends therebetween adjacent to the end of ear 76 in the path of its clockwise rotation, as viewed in FIG. 1. Removable shims 80 are mounted on the surface of stop member 78 facing toward ear 76. Stop member 78 is shimmed so that the end of resonant angle beam 64 adjacent to tool 60 is located in a desired position, usually so the upright leg thereof is vertical when the beam is in its neutral position. The neutral position of the beam is its position when at rest, i.e., when not resonating or being deflected.

When oscillator 68 is operating, it applies a reciprocating force to the end of the horizontal leg at or near the resonant frequency of angle beam 64. While resonant angle beam 64 resonates, the juncture of its legs, which is the single node, remains stationary and the end of its vertical leg reciprocates in forward and backward directions, striking tool 60 each time it moves forward in its reciprocating excursion. A changing gap is formed between the end of the vertical leg of resonant angle beam 64 and tool 60—as the vertical leg reciprocates in a forward direction the gap tends to close and as the vertical leg reciprocates in a backward direction the gap tends to open, disregarding the continuous forward movement of the frame.

Ripping tool 60 comprises a work tool that moves along through the soil, which comprises the work path. Ripping tool assembly 10 functions as a tool holder or carrier. Continuous unidirectional force is applied thereto by tractor 12 in a direction parallel to the work path. Oscillator 68 generates a reciprocating force, at least one component of which acts parallel to the work path. Resonant angle beam 64 comprises a force transmitting member, the end of its horizontal leg comprising an input to which the reciprocating oscillator force is applied, and the end of its vertical leg comprising an output from which the reciprocating force is transferred to the tool. The tool advances intermittently along the work path responsive to the continuous unidirectional force applied by tractor 12 and the reciprocating force applied by oscillator 68.

A minimum protective gap is established between the neutral position of resonant angle beam 64 and tool 60 by stop members 62 and 78. As a result, when tool 60 encounters an immovable object, which prevents its further advance, tractor 12 continues to advance until tool 60 abuts stop member 62. In other words, stop member 62 limits the backward movement of tool 60 so it cannot reach the neutral position of the beam output. Thus, the end of the vertical beam leg cannot become clamped by tool 60 when tool 60 encounters an immovable object, and destroy the components of the ripping tool assembly. In my referenced copending application a different way is disclosed for establishing a protective gap between the output of the beam and the tool when the tool encounters as immovable object, namely, the use of substantially more reciprocating oscillator force than the continuous unidirectional force provided by the mobile carrier. In a number of applications, however, requiring that the mobile carrier supply a very large continuous unidirectional force, such as a shovel bucket or a rock ripper, it is impractical to furnish sufficient reciprocating oscillator force to establish the gap in the manner described in the referenced copending application.

Recognizing that small variations in relative spatial position between components cannot be avoided in the manufacture and assembly of the components of ripping tool assembly 10, the length of the minimum protective gap is adjusted from machine to machine by shims 63 on stop member 62 and shims 80 on stop member 78. Instead of shimming both stop members 62 and 78, one or the other of these stop members alone could be shimmed to establish the minimum protective gap. In a typical example, the peak-to-peak excursion of the beam output might be 2 inches, and the minimum protective gap might be $\frac{1}{4}$ of an inch, so that the power stroke of the beam output would be $\frac{3}{4}$ of an inch. The minimum protective gap should be no longer than necessary to prevent cessation of resonance when the tool encounters an immovable object, because the larger this gap, the smaller the power stroke, i.e., the portion of the beam output excursion in which it contacts the tool.

If resonant angle beam 64 is driven at or near its resonant frequency without restraining the beam juncture from vibrating as disclosed herein, it has two nodes near its ends, as in the case of a straight resonant beam. Under some circumstances, it may be desirable to operate a resonant angle beam in this way, i.e., with two nodes, by supporting the beam at these two nodes, rather than at the beam juncture.

For an explanation of how stop members 62 and 78 protect ripping tool assembly 10, reference is made to FIG. 5, wherein the central horizontal line N represents the neutral position of the resonant angle beam 64, and more particularly the output thereof, and the dashed horizontal line S spaced thereabove, represents the rearmost position attainable by the ripping tool 60 when in engagement with stop member 62. The distance between N and S represents the minimum protective gap. The normal resonant swing of the output of the resonant angle beam 64 is represented by the solid line sine wave indicated at R. When the tool encounters a very hard material and can no longer advance, it moves against stop member 62, thereby limiting the excursions of the beam output to an amount equal to the minimum protective gap forward and backward of the neutral position, as represented by the dashed line sine wave R'. This limited excursion is enough to maintain angle beam 64 in resonance and accordingly prevent destruction of the assembly.

As shown in the described embodiment and particularly in FIG. 3, the short connection of the stub shafts 66 in the plates 65 provides a relatively weak support. Consequently, a slightly modified stronger mounting arrangement as shown in FIG. 6 can be utilized. As there shown, parallel side plates 82 are welded to an outwardly projecting ear 84 formed at the juncture of the legs of the angle beam 85 and extend adjacent the sides of the resonant angle beam 85 beyond its inner edge to support a tube 86 in aligned holes. Tube 86 in turn, carries a single shaft 88, mounted by bushings 90, and rubber hubs 92 in the side plates 94 of the frame. Tube 86 and beam 85 are fixed relative to shaft 88, which is rotatable in bushings 90 about side plates 94 of the frame.

While the tool driving apparatus has been described specifically in connection with a ripping tool, it will be apparent that it can also be applied to a cutter blade as of the type generally shown in my prior application referred to hereinabove, and also to a shovel bucket or other members of various types requiring considerable force in their operative functions. Consequently, the term "tool" is to be broadly construed.

The described embodiment of the invention is only considered to be preferred and illustrative of the inventive concept; the scope of the invention is not to be restricted to such embodiment. Various and numerous other arrangements may be devised by one skilled in the art without departing from the spirit and scope of this invention. For example, a non-resonant force transmitting member could be employed with advantage in some situations, although a resonant member is preferable. Furthermore, the advantages of having a resonant member with a single node located above the earth's surface can be achieved when the output of the beam strikes the tool from a position above the earth's surface.

What is claimed is:

1. Material cutting apparatus which comprises a ripping tool arranged to dig a trench in the earth or other material, a frame movably supporting said tool for earth engagement, a resonant member in the form of an angle beam having two divergent legs meeting at a juncture and exhibiting a single central vibrational node at said juncture when restrained, supported adjacent said tool, the end of one leg of the beam providing the tool engaging portion thereof, and being within striking distance of the tool for intermittent driving contact therewith, and means for energizing resonant vibration of said resonant member, said resonant member being supported so that its tool-engaging portion lies behind said tool in its direction of cutting motion into the earth, has lateral dimensions less than those of said tool, and engages said tool below the surface of the earth.

2. Material cutting apparatus according to claim 1, which comprises mobile support means for said frame, said tool, and said resonant member, the mobile support means lying on the earth surface above the tool engaging portion of the beam.

3. Material cutting apparatus according to claim 2, which comprises means supporting said tool and said resonant member for adjustment substantially perpendicularly relative to the surface of the earth being cut.

4. Material cutting apparatus according to claim 1, wherein said energizing means constitutes an eccentric weight oscillator connected to the end of the other leg of said resonant member.

5. Apparatus for performing work on an earthen medium comprising:

a ripping tool movable in backward and forward directions along a work path below the earth's surface to engage the medium;

an oscillator producing a reciprocating force having at least a component parallel to the work path;

means for transmitting the reciprocating force from the oscillator to the tool, said transmitting means being an angle beam with two straight, divergent legs meeting at an angle and configured to exhibit a single, central, vibrational node, one said leg providing an output that reciprocates in forward and backward directions about a neutral position responsive to the oscillator, the output having smaller lateral dimensions than the ripping tool and being located near the cutting surface of the ripping tool below the earth's surface, a changing gap being formed between the tool and the output as the output reciprocates, the gap tending to close and strike the tool as the output reciprocates in a forward direction and tending to open as the output reciprocates in a backward direction;

means for applying to the output of the transmitting means a continuous unidirectional force in the forward direction to advance the tool intermittently along the work path responsive to the unidirectional force and the reciprocating force; and a tool stop for maintaining a minimum protective gap between the neutral position of the output end and the tool when the tool is unable to advance responsive to the unidirectional force and the reciprocating force.

* * * * *